United States Patent [19]

Elfelt et al.

[11] 3,994,411

[45] Nov. 30, 1976

[54] CONTAINER LID WITH FOLDBACK DRINK OPENING

[75] Inventors: Walter Elfelt, Cleveland, Ohio; James H. Scruggs, Sandstone, Minn.

[73] Assignee: Anna J. Elfelt, Cleveland, Ohio

[22] Filed: Apr. 21, 1975

[21] Appl. No.: 569,831

[52] U.S. Cl. ..... 220/90.4; 220/269; 229/7 R; 229/43

[51] Int. Cl.[2] ..... A47G 19/22

[58] Field of Search ..... 220/90.2, 90.4, 90.6, 220/268, 269, 306, 270; 229/7 R, 43; 215/305; 222/541, 556

[56] References Cited

UNITED STATES PATENTS

| | | | |
|---|---|---|---|
| 2,276,577 | 3/1942 | Hahn | 229/7 R |
| 2,286,508 | 6/1942 | Rheinfels | 220/306 |
| 2,939,617 | 6/1960 | Hassler | 222/556 |
| 3,048,317 | 8/1962 | Cochrane et al. | 220/306 |
| 3,101,870 | 8/1963 | Betner | 220/269 |
| 3,302,858 | 2/1967 | Miller | 229/7 R |
| 3,355,060 | 11/1967 | Reynolds et al. | 220/270 |
| 3,387,765 | 6/1968 | Davis | 220/306 |
| 3,421,654 | 1/1969 | Hexel | 220/306 |
| 3,473,685 | 10/1969 | Karlan | 215/305 |
| 3,738,526 | 6/1973 | Zundel et al. | 220/269 |
| 3,822,030 | 7/1974 | Tanzer | 229/43 |
| 3,847,300 | 11/1974 | Waters | 222/541 |

*Primary Examiner*—George E. Lowrance
*Assistant Examiner*—Allan N. Shoap
*Attorney, Agent, or Firm*—Donnelly, Maky, Renner & Otto

[57] ABSTRACT

A lid for drink cups includes a drinking flap of limited circumferential extent that may be selectively pivotally opened and closed. Such drinking flap may initially be defined by frangible lateral edges in the lid and may be held in its open position by the pull tab on the flap being inserted in a slit for a straw orifice.

5 Claims, 2 Drawing Figures

CONTAINER LID WITH FOLDBACK DRINK OPENING

SUMMARY OF THE INVENTION

The present invention relates to a lid for a drink cup in general and to a foldback drinking flap in said lid in particular.

All kinds of drinks are currently being dispensed in plastic and paper containers, with the containers commonly being covered with removable lids. A problem often encountered is spillage of the drink when the lid has been removed. Such spillage may be accidentally caused or may be the result of a rough vehicle ride.

For cold drinks, this problem has been substantially reduced by providing a selectively opened, straw orifice in the lid. However, some people prefer not to use straws, and some drinks, for example coffee and hot chocolate, are not normally consumed through straws.

The principal object of the present invention is to provide a lid for drink cups having a foldback drinking flap that may be selectively opened and closed without removing the lid. Such drinking flap is initially laterally defined by two circumferentially spaced linear lines of weakness in the lid body, such lines of weakness being broken by the user.

It is another object of the present invention to provide a foldback drinking flap in a drink cup lid that may be positively held in the fully opened position, thereby not to interfere with the drinking process. Such object is accomplished by providing a slit in the lid that receives the pull tab on the drinking flap.

It is still another object of the present invention to provide a drink cup lid having both a foldback drinking flap and a straw orifice defined by two perpendicularly oriented and intersecting slits in the lid, thereby to be usable for any type of drink at any temperature. In such case, the drinking flap and straw orifice are preferably diametrically opposed to permit one of the slits of the straw orifice selectively to receive the flap pull tab to hold the flap in its fully opened position.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed. In said annexed drawing:

Figure 1:
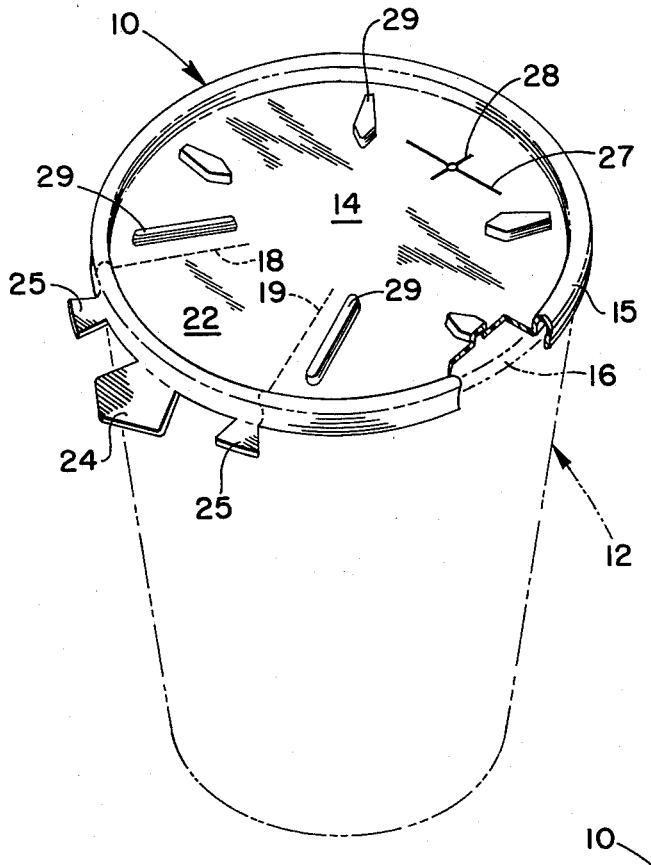
FIG. 1 is partially broken away perspective showing the lid of the present invention on a drink cup, with the drinking flap in its closed and, as yet, unbroken condition.
Figure 2:
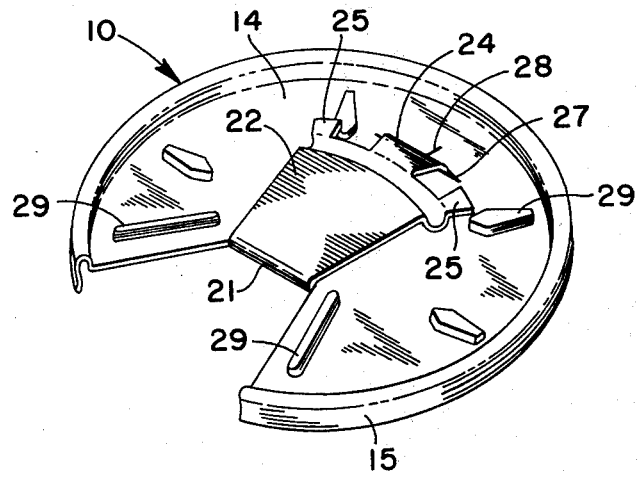
FIG. 2 is a perspective of the lid of the present invention with the drinking flap pivoted to its opened and selectively secured position.

Referring now in more detail to the drawing and initially to FIG. 1, the lid, indicated generally at 10, is removably secured on the top of a drink cup 12. Such cup is generally cylindrical but is flared slightly radially inwardly from top to bottom for ease of stacking. The cup, which forms no part of the present invention, may be made of any material suitable for the drink to be contained, with various plastics and laminated cardboard being commonly used materials.

The lid 10 consists of a generally circular body 14 peripherally having a circumferentially continuous down-turned channel 15. When the lid is on the cup, the channel embracingly receives the top lip 16 of the cup tightly to hold or seal the lid on the cup. As illustrated, the channel is specially internally configured intimately to receive and tightly engage the annular bead defining the top lip. The specific configuration or form of the connection between the lid and cup is not important as long as the same is operative tightly to hold the lid on the cup to preclude unintentional fluid passage. Any of the known lid holding devices operative to provide this function may be used with the present invention.

As shown, the lid 10 is manufactured with two circumferentially spaced lines of perforations 18 and 19. Such perforations extend equidistantly radially inwardly through the channel 15 and body 14 to spaced terminal points which eventually define the fold or pivot line 21. The lines of perforation 18 and 19 are preferably circumferentially spaced at channel 15 a distance greater than the average mouth width for ease of drinking. Additionally, the perforation lines preferably extend generally radially inwardly a distance less than the radius of lid 10 and slightly converge along their extent, although such lines do not have to be formed on true radii of such lid.

The drinking flap 22 is laterally defined by the lines of perforation 18 and 19. A generally outwardly extending pull tab 24 is provided on the channel 15 of the flap 22. Two additional pull tabs 25 may be provided immediately adjacent the perforations 18 and 19 to assist in opening such flap.

The body 14 of lid 10 is provided with a straw orifice, the latter preferably being diametrically opposed from drink flap 22. The straw orifice is defined by two perpendicularly positioned and intersecting slits 27 and 28. A straw, not shown, may be pushed through the slits at their intersection and into the contained fluid.

The body 14 of lid 10 may be provided with ribs 29 to rigidify such lid. As shown, two ribs 29 closely parallel perforation lines 18 and 19 to provide rigidity along the tear surfaces.

In operation, cup 12 is filled with a drink and subsequently covered by placing lid 10 thereon. Such lid is tightly, albeit removably, held on cup 12 by the peripheral channel 15 on lid body 14 intimately receiving and seizing the cup lid 16. If desired, a straw may be passed through the orifice formed by the perpendicular slits 27 and 28.

Alternately, or additionally, the user may grab tabs 24 or 25 and pull upwardly to break the perforations 18 and 19. This pull results in the drinking flap 22 pivoting upwardly about fold line 21, to open a limited circumferential area for drinking while still covering the major portion of the cup opening. The flap 22 may be pivoted until the pull tab 24 can be tucked or inserted into slit 27 of the straw orifice. Such insertion of pull tab 24 holds the flap 22 in its fully opened position, thereby not to interfere with the drinking process. Subsequently, flap 22 may be pivotally returned to its closed position with the channel thereon again receiving the cup lid. In such returned, closed position of the flap 22, the lid 10 again substantially precludes fluid spillage.

Although the invention has been shown and described with respect to a preferred embodiment, it is obvious that equivalent alterations and modifications will occur to others skilled in the art upon the reading and understanding of this application. For example, the perforated lines 18 and 19 defining the frangible lateral edges of the drink flap could take other forms, such as lines of thinner body wall thickness. For that matter, slits entirely passing through the lid body could also define the lateral edges of the drinking flap. Moreover, a reinforcing bead in the lid body between the inner ends of perforations 18 and 19 could be used to strengthen the fold line 21, although, for normal use, the regular thickness of the lid body is believed sufficient to provide the necessary hinge strength. The present invention includes all equivalent alterations and modifications, and is limited only by the scope of the claims.

The embodiments of the invention in which an exclusive property or privilege is claimed are defined as follows:

1. A lid for drink cups and the like comprising a body, sealing means on the periphery of the body to hold the lid on the top of the cup, a drink flap of limited width in the body that may be pivotally opened to permit drinking and pivotally closed to recover the limited drink opening, a first slit in the body and a pull tab on the periphery of the drinking flap, said pull tab being inserted in said slit when said drinking flap is in its open position selectively to hold the same in such open position.

2. The lid of claim 1 further comprising a second slit in the lid, said second slit perpendicularly intersecting the first slit to form a straw orifice.

3. The lid of claim 1 wherein the drink flap is initially defined by two spaced frangible lines of weakness in the lid body that must be broken to open the drink flap.

4. The lid of claim 3 further including pull tabs on the periphery of the drink flap proximate each line of weakness.

5. A lid for open top fluid containers and the like comprising a body, sealing means on the periphery of the body selectively to engage the top of the container tightly to hold the body on the container, a pivotal drinking flap of limited arcuate extent laterally described by two frangible lines of weakness in said body and said sealing means, said drinking flap having a pull tab on its periphery, and a straw opening in the body to receive said pull tab selectively to hold the flap in an open position after the frangible lines of weakness have been broken.

* * * * *